United States Patent [19]

Vaughan

[11] Patent Number: 5,062,629

[45] Date of Patent: Nov. 5, 1991

[54] SURFING SIMULATOR

[76] Inventor: Jeffrey R. Vaughan, Rte. 2-Box 324, Swall Meadows, Bishop, Calif. 93514

[21] Appl. No.: 658,000

[22] Filed: Feb. 20, 1991

[51] Int. Cl.[5] ..... A63B 69/18

[52] U.S. Cl. ..... 272/97; 272/146

[58] Field of Search ..... 272/111, 97, 114, 146; 434/247, 253

[56] References Cited

U.S. PATENT DOCUMENTS

| | | | |
|---|---|---|---|
| 4,509,743 | 4/1985 | Lie | 272/97 |
| 4,749,180 | 6/1988 | Boomer | 272/97 |
| 4,880,226 | 11/1989 | Krantz | 272/97 |
| 4,905,994 | 3/1990 | Hartz | 272/97 |
| 4,953,858 | 9/1990 | Zelli | 272/97 |
| 4,966,364 | 10/1990 | Eggenberger | 272/97 |
| 5,002,272 | 3/1991 | Hofmeister | 272/97 |

*Primary Examiner*—Richard J. Apley
*Assistant Examiner*—Lynne A. Reichard

[57] ABSTRACT

A surfing simulator which uses, in combination, a ball bearing turntable, an adjustable spring plate assembly and a flexible mounting pad to connect a riding deck to a stationary supporting base. In operation, the surfing simulator is mounted by stepping onto the riding deck near its center. As the user's feet are moved apart into the surfing stance, the user's weight can be shifted and rotational forces applied to create and sustain a complex rhythmic motion combining spin, tilt and rocking, which, when properly executed, enables the user to closely simulate and practice the movements, stances and reactions required to perform the sport of surfing.

6 Claims, 2 Drawing Sheets

SURFING SIMULATOR

BACKGROUND OF THE INVENTION

1. Field of the Invention

The invention relates to an exercise device for developing balance and coordination in general and, more specifically, to one which enables the user to simulate and practice the various stances, movements and reactions required to perform the specific sport of surfing.

2. Description of the Prior Art

Exercise devices and simulators for the sports of skiing, sailboarding and snowboarding are known. No such device for the specific sport of surfing in known. Closet known prior art in U.S. Pat. No. 4,966,364, Eggenberger, issued Oct. 30, 1990 entitled, "Snowboard Simulator."

Because surfing and snowboarding require many of the same balance skills and movements in their performance, simulators for these related sports and bound to share certain characteristics. However, there are important differences and improvements in this applicant's device when compared to the Eggenberger device.

The most obvious difference is that surfing requires a free movable stance whereas snowboarding is performed in a fixed stance with the use of boots and bindings. Therefore, this applicant's device is devoid of any foot mounting units, bindings, or straps common to many ski related devices. However, the removal of the foot mounting units from the Eggenberger device would not render the two devices essentially the same. This applicant's device is further different and improved in the following areas:

a. Safety

The Eggenberger device, as shown and described, has a small diameter base relative to the length of the snowboard-like frame the user stands upon. Such a base, unless rigidly attached to the floor, would be inherently unstable. Further, the Eggenberger device includes rubber tips beneath the foreward and rearward ends of the snowboard-like frame to, quote, "prevent abrubt contact with the floor in the event the user slopes the board too far toward the front or rear." When in motion, it would be undesirable for the device to inadvertently contact the floor. A sudden deceleration, caused by such contact, could throw the user off balance, and, by being confined within, quote, "foot mounting units," a fall could result in injury.

This applicant's device is an improvement in these regards: A smooth circular base approximately equal in diameter to the length of the riding deck is provided to give stability and resistance to tipping necessary during use. Further, the range of motion of applicant's device is limited by the travel of its springs and no contact with the floor is possible. This applicant's device does not include any restraints such as the Eggenberger foot mounting units, straps or bindings common to other devices which can trap or otherwise impede a dismount when a user loses their balance.

b. Adjustable Function

The Eggenber device as shown and described has no adjustable function to compensate for users of different sizes and weights or to provide adjustable riding characteristics.

Applicant's device is different and improved in this regard: Springs of different tension are interchangeable and can be deployed in various patterns to provide a wide range of adjustment to vary the sensitivity of the action or accommodate virtually any size user.

c. Materials and Their Arrangement

This applicant has built and extensively tested several working prototypes, using different materials and configurations and has found that different materials and their arrangement in the device greatly affect the riding characteristics and durability of the device, even though they produce the same general motion. For example, the Eggenberger device uses a, quote, "semi-soft cushion member" as its sole source of flexing motion with a steel bearing for rotational motion above this cushion member in direct contact with the board the user stands upon.

This applicant's device is different and improved in this regard: Using a turntable bearing mounted low, directly on the base for its rotational motion. A spring plate assembly is mounted above the bearing to provide an adjustable source of flexing motion while a beveled, tapered rubberlike mounting pad between the spring plate and the riding deck adds a secondary source of flexing motion and softens the coupling between the riding deck and the metallic feel of the steel bearing below.

This applicant has found that the fewer demands placed upon rubberlike components the more durable they tend to be. For example, when testing different prototypes, those which relied upon rubberlike or other elastomeric materials, for the larger gross movements of the device, failed more often either by tearing or the pulling out of attaching elements incorporated in them than those using steel spring plate assemblies for the same function.

Accordingly, this applicant's device is different from the Eggenberger device in basic design function, that being a surfing simulator as opposed to a snowboard simulator. Moreover, in those aspects in which the two devices are similar, this applicant's device is improved in the areas of safety, adjustable function, arrangement of elements and durability.

SUMMARY OF THE INVENTION

It is an aim of the invention to provide a dry land simulator and teaching aid for the instruction of the specific sport of surfing. It is a further aim of the invention to provide a stationary exercise device that is fun to use, safe, adjustable and durable; without being unduly complicated or expensive. A construction in accordance with these aims include a base, a ball bearing turntable, an adjustable spring plate assembly, a flexible mounting pad and an elongated contoured riding deck. These elements, by their arrangement in the device, enable the user, by shifting weight, to generate and sustain a complex rhythmic motion combining spin, tilt and rocking. This provides a pleasurable exercise activity while constantly challenging the user's balance, coordination and stamina in specific ways that simulate the movements and reactions required by the sports of surfing, skateboarding and snowboarding.

A particular benefit from the use of the device is a low impact aerobic workout in which the twisting and torquing of the lower body in opposition of the upper body exercises the muscles of the torso, especially the abdominals and the external obliques, making the device remarkably effective for trimming and slimming the waistline.

Still further objects and advantages will become apparent from a consideration of the following description and drawings.

DESCRIPTION OF THE PREFERRED EMBODIMENTS

Figure 1:
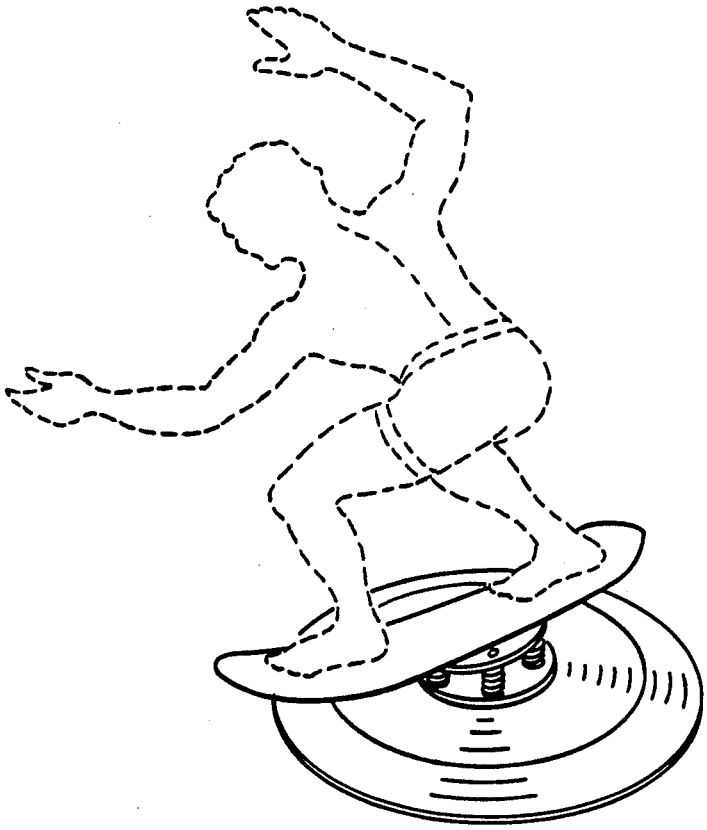
FIG. 1 is a front perspective view of applicant's surfing simulator in use showing the user in dotted lines.
Figure 2:
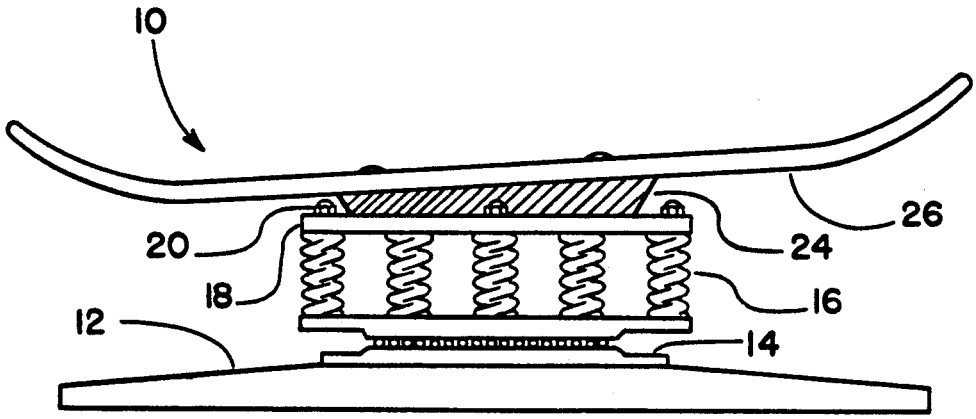
FIG. 2 is a side elevation of applicant's surfing simulator.
Figure 3:
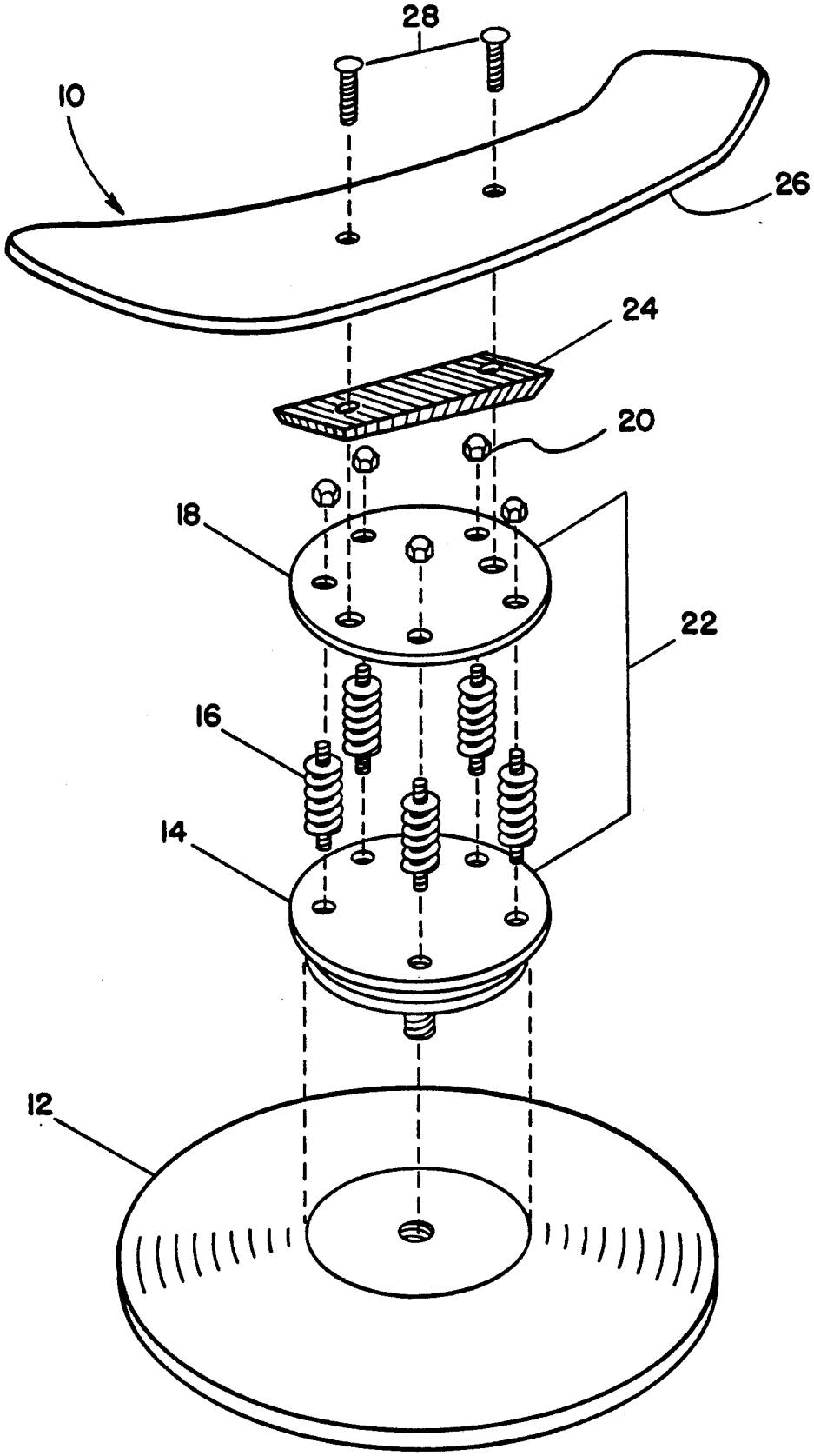
FIG. 3 is an exploded perspective of applicant's surfing simulator.

Applicant's surfing simulator is described by referring to FIGS. 1 to 3 which show a surfing simulator 10 which includes a circular support base 12 upon the center of which a ball bearing turntable 14 is removably attached.

The upper surface of the turntable 14 is a disc around whose perimeter, inward from its edge and spaced equidistant, are threaded bores.

Springs 16, having threaded studs centered at each end to facilitate their attachment and removal, are screwed into these bores.

A coverplate disc 18 having the same diameter and hole pattern as turntable 14 fits onto the top studs of the springs 16 and is then removably fastened with locknuts 20.

A spring plate assembly 22 is thus created that can be rotated 360 degrees by means of the turntable bearing 14 beneath it and simultaneously depressed in any direction.

Assembly 22 further allows easy removal and replacement of springs 16 of differing resistance to adjust the sensitivity of the action or accommodate users of different size and weight.

A beveled tapered mounting pad 24 is sandwiched between coverplate disc 18 and a riding deck 26 which is then removably attached to coverplate disc 18 by means of bolts and locknuts 28.

Riding deck 26 is elongated in shape and curved upwards at both ends. It is mounted so that the intersection of the midpoints of its length and width is concentric with the turntable bearing 14 beneath it.

In an embodiment not shown, riding deck 26 can be replaced by a cradle consisting of a longitudinal member having a padded crossmember at either end upon which an actual surfboard, sailboard or snowboard can be mounted by elastic means. In this alternate embodiment, springs 16 of greater stiffness would be installed in spring plate assembly 22 to resist the greater leverage exerted by the longer and larger equipment thus mounted.

In operation, the user mounts the simulator 10 by stepping onto the riding deck 26 near its center. As the user's feet are moved apart into a wider stance, the user's weight can be shifted and rotational forces applied to create and sustain a complex rhythmic motion combining spin, tilt and rocking, which, when properly executed, closely simulate the movements and reactions required to perform the specific sport of surfing.

I claim:

1. A surfing simulator comprising a supporting base, a turntable bearing removably attached concentrically upon the base to allow 360 degrees rotational motion, a plurality of springs having means for removable attachment to the upper surface of said turntable bearing to allow up-and-down motion, a cover plate, removably attached to the upper ends of said springs, thereby controllably coupling the up-and-down motion of said springs and the rotational motion of said turntable bearing a mounting pad deployed on the upper surface of said coverplate for resiliently mounting an elongated riding deck intermediate its length to the upper surface of said coverplate thereby coupling the riding deck to said coverplate, springs, turntable bearing and supporting base disposed concentrically thereunder.

2. A surfing simulator, as defined in claim 1, wherein said turntable bearing has a bottom plate in the form of a circular disc having an annular race, ball bearings located in the race, a top plate in the form of a circular disc of larger diameter than said bottom plate and having a mating annular race, said top plate, further having a plurality of threaded bores located around the perimeter of its upper surface inward from its edge, the two plates are rotatably attached concentrically.

3. A surfing simulator as defined in claim 1 wherein the mounting pad is beveled outwardly from its lower surface, thus presenting a larger upper surface upon which the deck is mounted, the mounting pad is further tapered in its long dimension, so that the deck mounted thereon is sloped slightly forward relative to the level base.

4. A surfing simulator as defined in claim 1 wherein said springs are interchangeable with springs of different resistance that can be deployed in various patterns to adjust the flexing motion of the simulator.

5. A surfing simulator as defined in claim 1 wherein said support base is in the form of a circular disc having a diameter approximately equal to the length of said riding deck.

6. A surfing simulator as defined in claim 1 wherein said elongated riding deck is curved upward and rounded at both ends; the main body of the deck being, to a small degree, concave in cross section.

* * * * *